US007025558B2

(12) United States Patent
Blotenberg

(10) Patent No.: US 7,025,558 B2
(45) Date of Patent: Apr. 11, 2006

(54) PROCESS FOR THE RELIABLE OPERATION OF TURBOCOMPRESSORS WITH SURGE LIMIT CONTROL AND SURGE LIMIT CONTROL VALVE

(75) Inventor: Wilfried Blotenberg, Dinslaken (DE)

(73) Assignee: Man Turbo AG, Oberhausen (DE)

( * ) Notice: Subject to any disclaimer, the term of this patent is extended or adjusted under 35 U.S.C. 154(b) by 67 days.

(21) Appl. No.: 10/763,103

(22) Filed: Jan. 22, 2004

(65) Prior Publication Data

US 2004/0151576 A1 Aug. 5, 2004

(30) Foreign Application Priority Data

Jan. 31, 2003 (DE) ..... 103 04 063

(51) Int. Cl.
*F04D 27/02* (2006.01)

(52) U.S. Cl. ..... 415/1; 415/17

(58) Field of Classification Search ..... 415/1, 415/17, 30, 36, 159, 160, 163
See application file for complete search history.

(56) References Cited

U.S. PATENT DOCUMENTS

| | | | | |
|---|---|---|---|---|
| 4,148,191 | A * | 4/1979 | Frutschi | 60/652 |
| 4,810,163 | A | 3/1989 | Blotenberg | |
| 4,825,380 | A | 4/1989 | Hobbs | |
| 4,831,535 | A * | 5/1989 | Blotenberg | 415/1 |
| 4,946,343 | A | 8/1990 | Blotenberg | |
| 4,949,276 | A | 8/1990 | Staroselsky et al. | |
| 5,195,875 | A | 3/1993 | Gaston | |
| 5,290,142 | A | 3/1994 | Ispas et al. | |
| 5,743,715 | A * | 4/1998 | Staroselsky et al. | 415/1 |
| 5,765,991 | A | 6/1998 | Blotenberg | |
| 5,908,462 | A | 6/1999 | Batson | |
| 5,960,624 | A | 10/1999 | Blotenberg | |
| 6,164,901 | A | 12/2000 | Blotenberg | |
| 6,193,470 | B1 | 2/2001 | Aurbeck | |
| 2001/0022938 | A1 | 9/2001 | Blotenberg | |
| 2002/0062679 | A1 | 5/2002 | Petrosov | |

FOREIGN PATENT DOCUMENTS

| | | |
|---|---|---|
| DE | 35 40 087 A1 | 5/1987 |
| DE | 35 44 822 A1 | 6/1987 |
| DE | 38 09 881 C2 | 5/1990 |
| DE | 689 16 555 T2 | 10/1994 |

(Continued)

*Primary Examiner*—Edward K. Look
*Assistant Examiner*—Igor Kershteyn
(74) *Attorney, Agent, or Firm*—McGlew & Tuttle, P.C.

(57) ABSTRACT

A process for the reliable operation of turbocompressors with a surge limit control and a surge limit control valve is described, in which the compressor delivers gases with different compositions and the composition of the gas (molecular weight) affects the performance characteristic of the turbocompressor and hence the position of the surge limit in the performance characteristic. The different compositions of the gases are compensated here with the effect on the position of the surge limit and consequently on the position of the surge limit control line by using predetermined design values for the gas constant R, the isentropic exponent k and the compressibility number z within the surge limit control for the determination of the delivery head Δh and the volume flow V and plotting them in the form of a predetermined surge limit line (FIG. 2, FIG. 4), wherein the set point and the actual value are determined for the surge limit control from the graph, and the compressor is operated with the set points and actual values determined for the surge limit control with a minimally necessary distance from the surge limit.

4 Claims, 7 Drawing Sheets

FOREIGN PATENT DOCUMENTS

| | | | |
|---|---|---|---|
| DE | 42 02 226 | C2 | 6/1995 |
| DE | 43 16 202 | C2 | 4/1998 |
| DE | 198 01 041 | C1 | 8/1999 |
| DE | 198 12 159 | A1 | 9/1999 |
| DE | 100 12 380 | A1 | 9/2001 |
| DE | 198 28 368 | C2 | 10/2001 |
| DE | 100 46 322 | A1 | 4/2002 |
| EP | 0 810 358 | A2 | 12/1997 |
| EP | 0 757 180 | B1 | 10/2001 |
| JP | 07012090 | A | 1/1995 |

* cited by examiner

PROCESS FOR THE RELIABLE OPERATION OF TURBOCOMPRESSORS WITH SURGE LIMIT CONTROL AND SURGE LIMIT CONTROL VALVE

FIELD OF THE INVENTION

The present invention pertains to a process for the reliable operation of turbocompressors with surge limit control and a surge limit control valve, wherein the compressor delivers gases of different compositions, and the composition of the gas (molecular weight) affects the performance characteristic of the turbocompressor and consequently the position of the surge limit in the performance characteristic.

BACKGROUND OF THE INVENTION

DE 198 28 368 C2 discloses a process for operating two-stage or more than two-stage compressors, in which each compressor stage has a separate surge limit control valve arranged between a delivery line via a blow-by line and an intake line. The surge limit control valve blows off into the intake line of the corresponding compressor stage. Furthermore, a flow computer for computing the intake flow as well as a computer for the minimum allowable desired flow, which is determined from the end pressure or the delivery head, are provided.

Furthermore, EP 0 810 358 A2 discloses a process for controlling gas pressures of a regenerator with a gas expansion turbine in the flue gas line with a generator, wherein a process controller opens the inlet fittings of a gas expansion turbine and/or the bypass fittings or throttles the bypass fittings. A plurality of resolver transmitters, which preset the manipulated variables for the downstream fittings, are arranged downstream of the process controllers.

Moreover, DE 100 12 380 A1 discloses a process for protecting a turbocompressor with the downstream process from operation in the unstable working range, wherein a machine controller is used, which optionally has a suction pressure controller, an end pressure controller and a bypass controller, besides a surge limiter. A control matrix is determined from the position of a control unit that determines the flow to the process, optionally taking into account additional influencing variables, such as the compressor suction pressure and the compressor outlet pressure and the compressor suction temperature as well as the process pressure. Based on the control matrix, the necessary position of the surge limit control valve as well as of the bypass valve, of the suction pressure control valve and of the actuating drive is determined directly for the compressor inlet blades in the case of a rapid transient change in the working point. The actuating variable determined is then sent directly as a manipulated variable to the surge limit control valve, the suction pressure controller, the end pressure controller and the bypass controller.

Furthermore, EP 0 757 180 B1 discloses a process for avoiding controller instabilities in surge limit controls for protecting a turbocompressor from surging if the proportional sensitivity of the surge limiter was selected to be too high by means of blow-off via a blow-off valve. The speed with which the blow-off valve closes over time takes place is controlled by means of an asymmetric gradient limiter, with no time limitation being effective in the opening direction. However, a parametrizable time limitation of the closing operation of the blow-off valve is provided in the closing direction.

It is assumed in the prior-art processes that the position of the surge limit in the performance characteristic of the compressor is known. The coordinates of the working point are usually plotted in the performance characteristic as compression work or enthalpy difference or delivery head as a function of the suction volume flow. The parameters of the particular variables must be known as well.

SUMMARY OF THE INVENTION

The basic object of the present invention is to propose a process for the reliable operation of a turbocompressor, which is also able to reliably process gases of different compositions, which is not sufficiently known especially concerning the variables for the gas constant R and the isentropic exponent k. The basic object is accomplished in that the different compositions of the gases are compensated with the effect on the position of the surge limit and consequently also on the location of the surge limit control line by using predetermined design values for the gas constant R, the isentropic exponent k and the compressibility number z within the surge limit control for the determination of the delivery head (enthalpy difference) $\Delta h$ and the volume flow V and plotting them in the form of a predetermined surge limit control line (FIG. 2, FIG. 4) within the surge limit control, the set point and the actual value for the surge limit control being determined from the graph and the compressor being operated with the set points and actual values determined for the surge limit control with a minimally necessary distance from the surge limit.

Furthermore, it proved to be advantageous to plot a number of characteristics with constant speed or with constant geometry (guide vane position or position of a throttling fitting), wherein a family of curves each is described with surge limit lines for a constant speed or constant compressor geometry and to interpolate between the different curves and to correctly determine the surge limit control line for each speed or compressor geometry, and to operate the surge limiter with the minimally necessary distance from the surge limit.

Moreover, it proved to be especially advantageous that a single "fictitious" control line, whose position depends on the performance characteristic and is determined by the surge points located farthest to the right, is plotted instead of the interpolation between different surge limit control lines.

As an alternative, the process can be used for reliably operating turbocompressors with surge limit control and a surge limit control valve in which the compressor delivers gases with different compositions and the composition of the individual gases (molecular weight) leaves the performance characteristic of the turbocompressor and consequently the position of the surge limit in the performance characteristic unaffected, and a predetermined design value for the gas constant R, the isentropic exponent k and the compressibility number z is used within the surge limit control for determining the delivery head $\Delta h$ and the volume flow V, and it is plotted in the form of a predetermined surge limit line (FIG. 1) within the surge limit control, wherein the set point for the surge limit control is determined from the graph and the actual value is calculated from the measured variables determined, and the compressor is operated with the set points and actual values determined for the surge limit control with a minimally necessary distance from the surge limit.

The position of the surge limit in the performance characteristic of a compressor is made use of in the surge limit control as one of the essential protective means for turbocompressors. The minimum allowable flow through the compressor is determined as the set point for the surge limiter from the enthalpy difference within the surge limit control. Correct surge limit control and consequently reliable protection of the machine are then possible in the knowledge of the enthalpy difference and the volume flow.

The formulas for determining the coordinates of the enthalpy difference delta h or Δh and the volume flow V are as follows:

$$\Delta h = \frac{k \cdot R \cdot z \cdot T_1}{k-1} \cdot \left[ \left\{ \frac{p_2}{p_1} \right\}^{\frac{k-1}{k}} - 1 \right]$$

and $$\dot{V} = K \sqrt{\frac{\Delta p_1 \cdot R \cdot z \cdot T_1}{p_1}}$$

in which

R is the gas constant, k is the isentropic exponent, z is the compressibility number, $T_1$ is the temperature on the intake side, $p_1$ is the pressure on the intake side, $p_2$ is the pressure on the delivery side, K is the parametrization constant for the flow, and $\Delta p_1$ is the differential pressure over the differential pressure sensor on the intake side.

The parameters R and k as well as z depend on the gas composition. R is the gas constant, k is the isentropic exponent, and z is the compressibility number. The composition of the gas being compressed by the compressor is usually known. Only one gas, e.g., air, nitrogen or a process gas with a composition that is constant over time is compressed in a chemical process in the overwhelming majority of cases. The variables R, k and z are constant over the entire operating time of the compressor and can therefore be taken into account as constants in the formulas for calculating the enthalpy difference and the volume flow. The variables enthalpy difference and volume flow are determined physically correctly in this case.

However, processes in which the composition of the gas may change over time are also known in some applications, especially in the chemical industry. The variables R, k and z are no longer constant in this case, but they must be considered to be variables that change over time. If the variables R, k and z can always be presumed to be constant or to be able to be accurately determined by measurement at any time, these can be taken into account within the underlying formulas. The enthalpy difference and the volume flow are also determined physically correctly in these cases. Reliable protection of the machine by means of the correctly determined values for the set point and the actual value is possible.

By contrast, compressors are operated in other applications with variable gas composition, where the gas composition is not known in the particular case. The shape of the surge limit, which shape must be taken into account within the surge limit control, is different with different compressors depending on the composition of the gas. However, it is normally impossible to take into account a different shape of the surge limit without the knowledge of the gas parameters R, k and z.

The process according to the present invention is therefore to be used in the case of compressors for which the shape of the surge limit or the surge limit control line in the performance characteristic shows a dependence on at least one gas composition.

A process will be described below by means of which it is possible to exactly determine the difference between the set point and the actual value for the surge limit control even if the gas composition is not known and thus to optimally protect the compressor from operating in the unstable range.

The process will be described below on the basis of exemplary embodiments, whose characteristics are shown. For better understanding, the process will first be described for a compressor with constant speed and constant geometry (fixed guide vanes and without throttling fitting). The process will subsequently be generalized to any compressor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
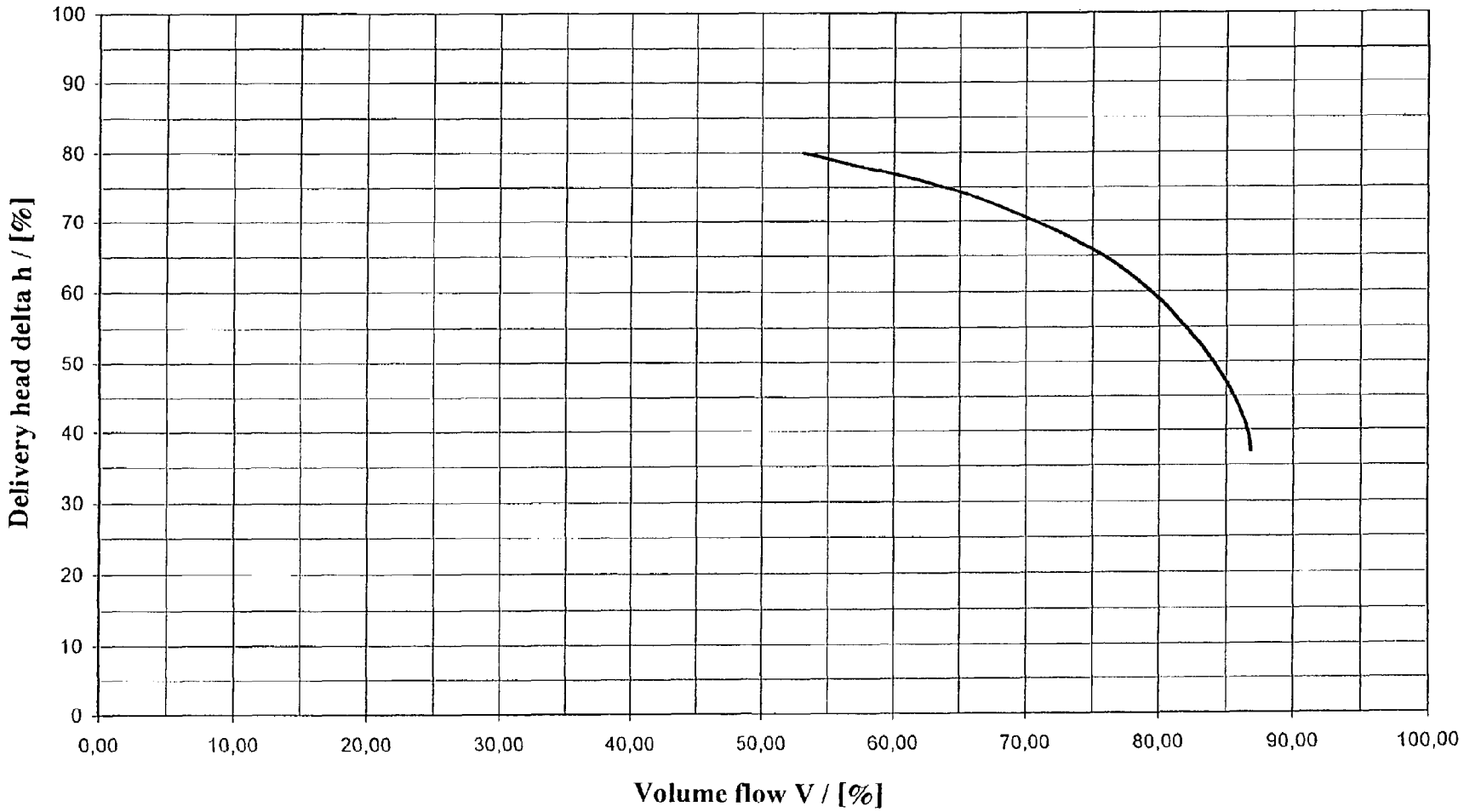
FIG. 1 is a diagram showing the characteristic of a compressor with constant speed and fixed geometry.

Referring to the drawings in particular, FIG. 1 shows the characteristic of a compressor with constant speed and fixed geometry.

There are compressors for which the performance characteristic according to FIG. 1 is independent from the gas composition. The characteristic in the performance characteristic Δh over V is such that this is generally valid for all gases being delivered.

Other compressors are designed such that a different characteristic with another surge point is obtained for each gas composition.

Figure 2:
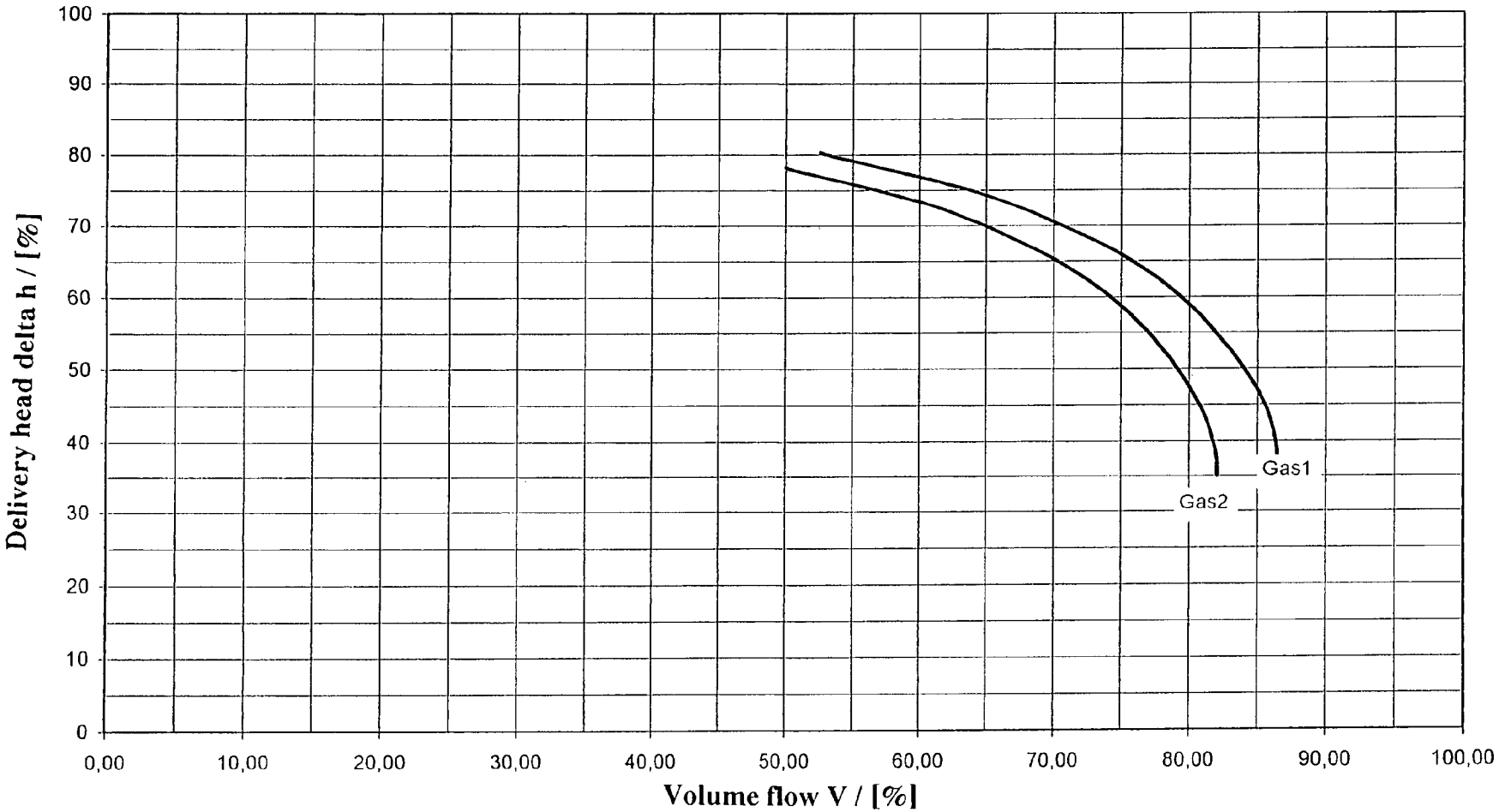
FIG. 2 is a diagram showing the characteristics of a compressor for two gases.

FIG. 2 shows, for example, the characteristic of a compressor whose characteristic and consequently also the position of the surge point depend on the gas composition.

The essential difference between the case according to FIG. 1 and that according to FIG. 2 is that in the case of a universally valid characteristic according to FIG. 1, the characteristic and consequently the surge point needs to be calculated for one gas composition only. The shape of the characteristic needs to be valid for one gas only during the acceptance measurements in the test shop.

If another characteristic applies to each gas composition, as is shown in FIG. 2, the compressor shall be designed thermodynamically for all occurring gas compositions or at least for some representative gas compositions. The characteristics are then to be verified in the test shop by corresponding measurements with different gases.

The difference shown is not of any special significance for the process described below. The difference is mentioned only for completeness' sake.

A compressor according to FIG. 1 will first be assumed below.

To determine the position of the working point in the performance characteristic, it is necessary to exactly determine the delivery head Δh and the volume flow V. As a result, the position of the current working point relative to the surge limit can be determined. Because of the known formulas for the delivery head Δh and the volume flow V, this requires the exact knowledge of the variables R, k and z. However, these variables are often unknown. It is therefore assumed that the variables R, k and z cannot be determined by measurement and cannot be used as known variables for the determination of Δh and V. Consequently, only a single parameter set for R, k and z can be used in the determination of the working point. Different parameter sets cannot be used, because there is no criterion according to which a change-over between the different parameter sets can be performed.

The data of the gas composition, with which the compressor is operated for most of the time, are usually used for the change-over to different parameter sets, and the values of the gas composition for which the compressor was designed (hereinafter also called design values) are used. The position of the working point in the performance characteristic is also determined correctly as long as the composition of the gas being delivered exactly corresponds to the design.

If, by contrast, the composition of the gas has changed, a computer provided for determining the delivery head Δh and the volume V cannot determine these values correctly any longer because the variables R, k and z cannot be determined by measurement. Instead of the correct values for R, k and z, the computer uses only incorrectly preset values. An error will occur, whose value depends on the deviation of the current gas composition from the design values used for Δh and V in the formula for the calculation.

The characteristic from FIG. 1 can be converted into "fictitious" characteristics in the knowledge of the assumed errors because the values of R, k and z cannot be determined by measurement. The characteristics which are determined by the surge limiter with the use of the incorrectly preset values for R, k and z are then obtained.

Figure 3:
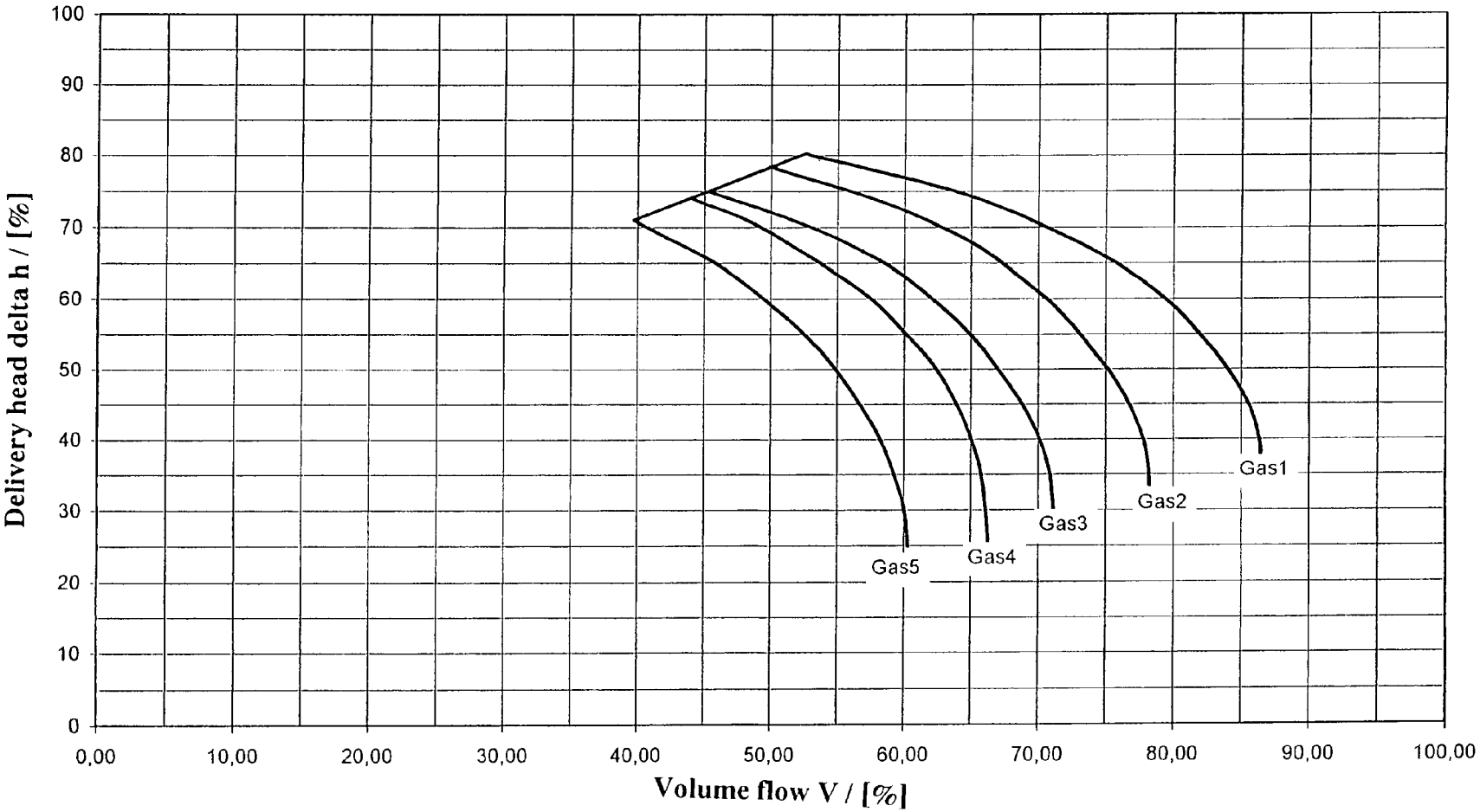
FIG. 3 is a diagram showing the characteristics of a compressor for five different gases.

FIG. 3 shows the shape of the particular compressor characteristics for different gas compositions according to FIG. 1, the way the shape is determined by a surge limiter without the knowledge of the actual gas composition. A different characteristic with a different surge point is obtained for each gas mixture. Different surge points, which can be connected by a line, are formed from the surge point in FIG. 1. The surge point in FIG. 1 thus becomes a "fictitious" surge limit line.

The fictitious surge limit line can be reproduced within the surge limit control, and a control line according to the "fictitious" surge limit line can be preset for the protection system of the compressor (surge limit control). Normal features of the surge limit control are used for this. Each surge limit control is designed, e.g., to control a compressor with variable speed or variable geometry. Each of such compressors is described by a performance characteristic with different speed characteristics or different geometries (guide vane position or throttle valve position). Each of the characteristics of such a "normal" compressor ends in a surge point. The connection of such surge points yields the surge limit line. Analogously to this, a surge limit line of equal form is obtained for a compressor with fixed geometry and fixed speed in the case of variable gas composition. The surge limiter consequently requires no additional features to also cover the case of any variable gas composition with fixed geometry and fixed speed.

The process operates according to the method that the controller error, which arises from the fact that the actual gas composition is unknown to the surge limiter of a compressor, is predetermined during the determination of the "fictitious" surge limit. The inevitably arising error is thus sent to the surge limiter in advance in a superimposing manner by the computer provided, in which the occurring error was taken into account in advance. Due to the fact that the occurring errors were taken into account in advance, the compressor can be protected reliably and accurately during the operation of a compressor with different gases even if the gas composition of the gas being actually delivered is not known at all.

The process can also be applied in a compressor whose characteristic shows a dependence on the gas composition according to FIG. 2. For example, the data for the gas composition, with which the compressor is frequently operated, shall be used in the surge limiter to determine the variables Δh and V. The corresponding data shall be those according to the upper characteristic in FIG. 2.

Figure 4:
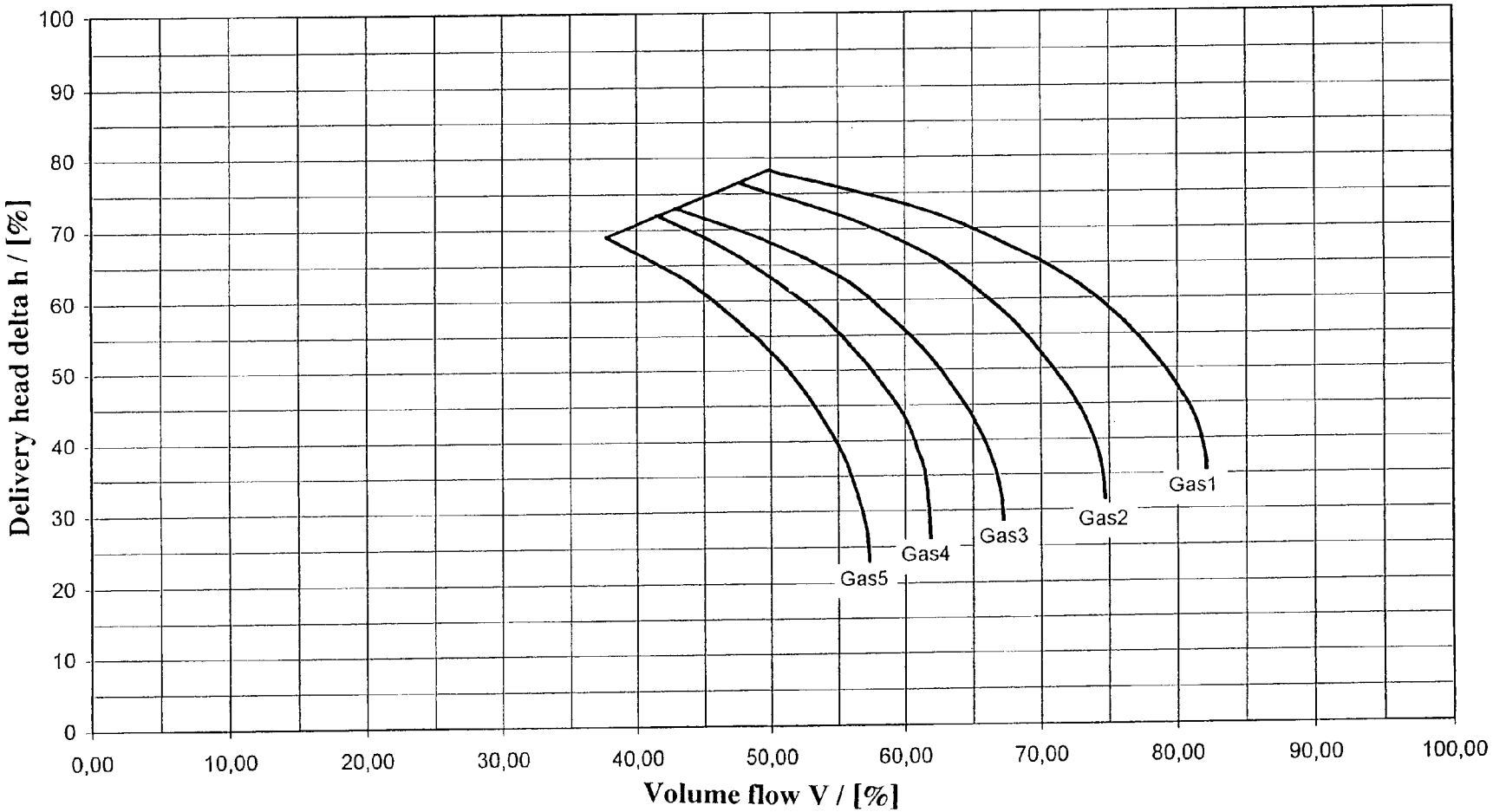
FIG. 4 is a diagram showing the characteristics of a compressor for similarly different gases as in FIG. 3.

Similarly to FIG. 3, five characteristics are plotted in FIG. 4. The upper characteristic corresponds exactly to the upper characteristic according to FIG. 3. The other characteristics are shifted in relation to those in FIG. 3. The characteristics were converted such that the same values that apply to the other characteristics were used instead of the correct values for R, k and z. The view in FIG. 4 thus corresponds to the view in FIG. 3. A "fictitious" surge limit, which has universal validity even if the composition of the gas currently being delivered is unknown, is obtained in both cases.

A universal control line, which optimally protects the compressor in the entire range of use even without the knowledge of the gas composition, can be derived from the "fictitious" surge limit line according to FIGS. 3 and 4.

It is irrelevant which parameter set is used for which gas composition, the only thing that is important being that the same parameter set be always used.

The purpose of the surge limit control is to always operate the compressor as close to the surge limit as possible. A control deviation between the minimally allowable flow and the current flow is formed for this purpose and sent to the surge limiter. Due to the formation of a control deviation, the fictitious surge limit line assumes such a shape that the calculation errors occurring because of the unknown variables R, k and z of a gas composition will mutually offset each other during the determination of Δh and the current volume flow V.

If the surge limit line thus determined is used within the surge limit control, the compressor is always sufficiently protected from operating in the unstable range of the performance characteristic, even if the gas composition is subject to greater variations.

The process becomes somewhat more complicated when the compressor is operated with variable speed or with variable geometry (guide vanes, inlet guide vane or throttling fitting) and variable gas composition. A surge limit line or a surge limit control line is already obtained in the case of compressors of such a design only in the case of constant gas composition. As is known, the compressor must never be operated beyond, i.e., to the left of the surge limit line. To make it possible to ensure this, a control line is positioned to the right of the surge limit with a sufficient safety margin such that the surge limiter can always operate the compressor outside the surge limit range even under extreme operating conditions.

There are many turbocompressors, especially multi-stage machines, in which especially the course of the surge limit line in the performance characteristic depends on the gas composition.

A surge limit line or a surge limit control line of a different shape may be obtained for each gas composition in the case of variable geometry or variable speed and variable gas composition. The surge limit line or the surge limit control line becomes a family of surge limit lines and surge limit control lines.

Each characteristic of the original performance characteristic (FIG. 5) is determined in advance for the different gas compositions according to the above-described process. A surge limit line, which is valid for this speed or for this throttle valve position or guide vane position only, is obtained from the surge point of the characteristic. The application of this process to all characteristics of the original performance characteristic leads to a family of surge limit lines. Each of these lines is valid for one speed or guide vane position or throttle valve position. Since the speed and the position of the throttle valve or guide vane can be determined by measurement in a simple manner, the surge limit line valid for the particular speed and throttle valve position or guide vane position can always be preset for the surge limiter. Interpolation between the characteristics can be performed by means of the central computer unit, so that the presetting must be performed for a limited number of characteristics only.

The measurement of the speed and the guide vane position or the throttle valve position is done away with in another, simpler approach. As a result, the apparatus required becomes simpler and the entire system hence becomes less expensive, but the usable range of the performance characteristic becomes somewhat limited, because the most unfavorable case is always assumed in this process.

One advantage of the simplified approach is that the classical surge limit control can be used for the protection of such compressors without any modification. The necessary surge points for the different compressor geometries or speeds and the possible gas compositions shall preferably be taken into account for this in a common performance characteristic. A surge limit range is obtained as a result. The shape of the surge limit line that is decisive for the surge limit control is obtained by connecting the surge points located farthest to the right, i.e., at the greatest volume flows. It is ensured as a result that regardless of the particular gas composition used, which is, however, unknown, there is a sufficient safety margin from the current surge limit.

Figure 6:
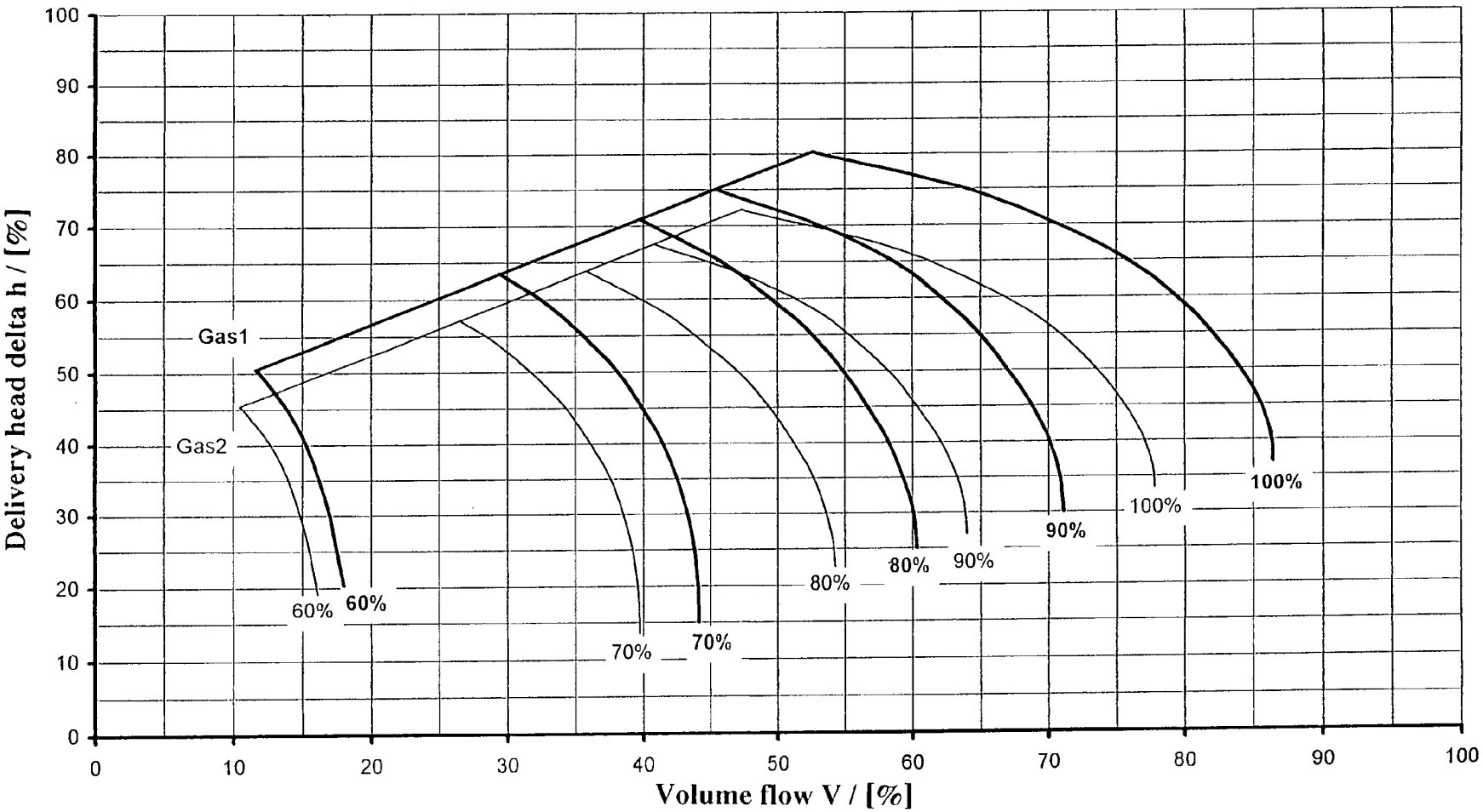
FIG. 6 is a diagram showing the characteristics of a compressor at a percentage of the nominal speed for two gases.

FIG. 6 shows the two performance characteristics of a surge limit control at a percentage of the nominal speed for two gases.

Figure 7:
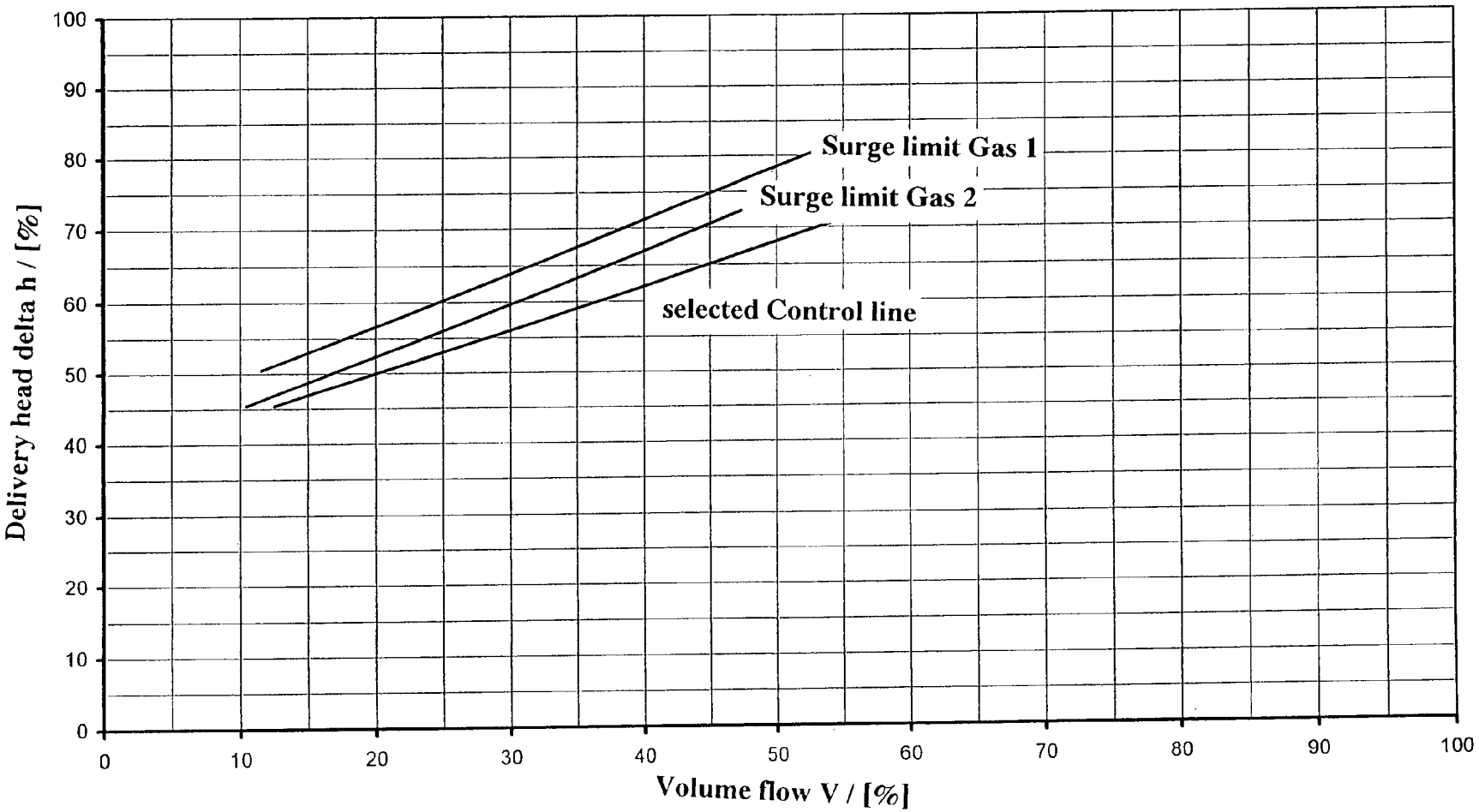
FIG. 7 is a diagram showing the control characteristics of a compressor with surge limits of two gases and a selected control line.

FIG. 7 shows the position of the predetermined "fictitious" surge limit lines for the two gases as well as the corresponding control line selected, whose position depends on the surge limit located farthest to the right.

By changing the gas composition, the fictitious surge limit line or the universal surge limit control line widens into a performance characteristic of fictitious surge limit lines or universal control lines.

Figure 5:
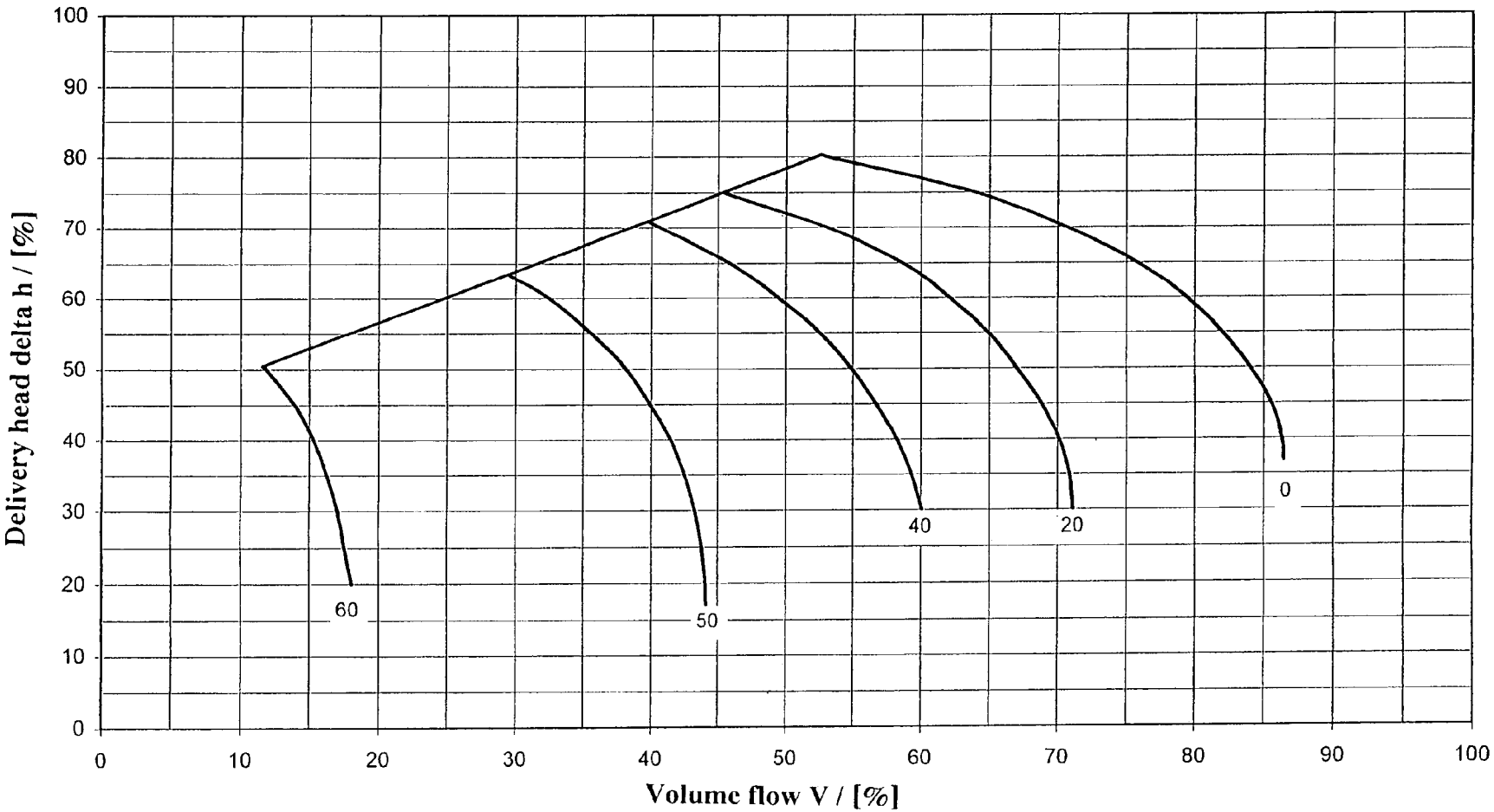
FIG. 5 is a diagram showing the characteristics of a compressor for different angles of the adjustable guide vanes.

The performance characteristics of fictitious surge limit lines or universal control lines are shown in FIGS. 5 and 6. The characteristic in FIG. 1 becomes the performance characteristic according to FIG. 5 because of the variable speed or the variable geometry. Each of these characteristics (for a fixed gas composition) according to FIG. 5 can be converted into a performance characteristic (for variable gas composition) according to the above-described process. Since each of the characteristics is limited by a surge point, a surge limit line is obtained in each of the performance characteristics. Since each characteristic in FIG. 5 is characterized by a fixed speed and a fixed compressor geometry, each performance characteristic in FIG. 6 and consequently each surge limit line in FIG. 6 is characterized by a fixed speed and a fixed compressor geometry.

Since both the speed and the compressor geometry (which is variable due to adjustable guide vanes or throttling fittings) can be easily determined by measurement, the characteristic that is relevant for the particular mode of operation can always be selected by measuring the speed and the compressor geometry.

Operating points between two characteristics can be accurately determined by numeric interpolation.

While specific embodiments of the invention have been shown and described in detail to illustrate the application of the principles of the invention, it will be understood that the invention may be embodied otherwise without departing from such principles.

What is claimed is:

1. A process for the reliable operation of turbocompressors with surge limit control and a surge limit control valve, wherein the compressor delivers gases with different compositions and the composition of the gas (molecular weight) affects the performance characteristic of the turbocompressor and consequently the position of the surge limit in the performance characteristic, the process comprising:

compensating the effect on the position of the surge limit and hence also on the position of the surge limit control line based on different compositions of the gases by using predetermined design values for the gas constant R, the isentropic exponent k and the compressibility number z within the surge limit control for determining the delivery head $\Delta h$ and the volume flow V and plotted in the form of a predetermined surge limit within the surge limit control; and determining the set point and the actual value for the surge limit control from the graph plotted in the form of a predetermined surge limit; and operating the compressor with the determined set points and actual values for the surge limit control with a minimally necessary distance from the surge limit.

2. A process in accordance with claim 1, further comprising:

plotting a number of characteristics with constant speed or with constant geometry including one or more of guide vane position or position of a throttling fitting, wherein a family of curves is described with surge limit control lines for a constant speed or constant compressor geometry, and that interpolation is performed between the different curves and the surge limit control line is correctly determined at each speed or compressor geometry, and the surge limiter is operated with the minimally necessary distance from the surge limit.

3. A process in accordance with claim 1, further comprising:

plotting a single "fictitious" control line, whose position depends on the performance characteristic and is determined by the surge points located farthest to the right and the surge limiter is operated with the minimally necessary distance from the surge limit.

4. A process for the reliable operation of turbocompressors with a surge limit control and a surge limit control valve, wherein the compressor delivers gases with different compositions and the composition of the individual gases (molecular weight) leaves the performance characteristic of the turbocompressor and hence the position of the surge limit in the performance characteristic unaffected, the process comprising:

using a predetermined design value for the gas constant R, the isentropic exponent k and the compressibility number z within the surge limit control for the determination of the delivery head $\Delta h$ and the volume flow V and plotted in the form of a predetermined surge limit within the surge limit control;

determining the set point and the actual value for the surge limit control from the graph plotted with the predetermined surge limit; and operating the compressor with the determined set points and actual values for the surge limit control with a minimally necessary distance from the surge limit.

* * * * *

UNITED STATES PATENT AND TRADEMARK OFFICE

CERTIFICATE OF CORRECTION

PATENT NO. : 7,025,558 B2
APPLICATION NO. : 10/763103
DATED : April 11, 2006
INVENTOR(S) : Wilfried Blotenberg It is certified that error appears in the above-identified patent and that said Letters Patent is hereby corrected as shown below:

On The Title Page:
Item (73) Assignee "Man Turbo AG" should read -- MANTURBO AG --

Signed and Sealed this

Nineteenth Day of September, 2006

JON W. DUDAS
*Director of the United States Patent and Trademark Office*